US009386842B2

(12) United States Patent
Doherty

(10) Patent No.: US 9,386,842 B2
(45) Date of Patent: Jul. 12, 2016

(54) BROOM WITH HOOKED BRISTLES SECTION

(71) Applicant: David Scott Doherty, Peterborough, NH (US)

(72) Inventor: David Scott Doherty, Peterborough, NH (US)

( * ) Notice: Subject to any disclaimer, the term of this patent is extended or adjusted under 35 U.S.C. 154(b) by 177 days.

(21) Appl. No.: 14/091,233

(22) Filed: Nov. 26, 2013

(65) Prior Publication Data

US 2015/0013718 A1 Jan. 15, 2015

Related U.S. Application Data

(60) Provisional application No. 61/845,112, filed on Jul. 11, 2013.

(51) Int. Cl.
*A46B 9/02* (2006.01)

(52) U.S. Cl.
CPC ..... *A46B 9/026* (2013.01); *A46B 9/025* (2013.01); *A46B 2200/302* (2013.01)

(58) Field of Classification Search
CPC ..... A46B 9/025; A46B 9/026; A46B 9/028; A46B 2200/302; A46D 1/0253
See application file for complete search history.

(56) References Cited

FOREIGN PATENT DOCUMENTS

DE 202010010864 U1 * 12/2010
WO WO 2008033957 A2 * 3/2008

OTHER PUBLICATIONS

English Machine Translation of DE 20 2010 010864 U1.*
http://www.home-ec101.com/cleaning-101-got-me-the-dustpan-blues/; Heather Solos, How to Sweep; May 23, 2007, pp. 1-2.*

* cited by examiner

*Primary Examiner* — Nicole Blan
(74) *Attorney, Agent, or Firm* — Dunlap, Bennett & Ludwig PLLC

(57) ABSTRACT

A broom with hooked bristles section that may include a broom handle and a broom head having an upper section, a lower section, a first side and a second side. The broom handle may attach to the upper section of the broom head. A plurality of straight bristles may attach to the first side of the lower section of the broom head, while a plurality of hooked bristles may attach to the second side of the lower section of the broom head. The plurality of hooked bristles allows for the ability to collect and remove debris from underneath objects.

6 Claims, 2 Drawing Sheets

BROOM WITH HOOKED BRISTLES SECTION

CROSS-REFERENCE TO RELATED APPLICATION

This application claims the benefit of U.S. provisional application No. 61/845,112, filed Jul. 11, 2013, the contents of which are herein incorporated by reference.

BACKGROUND OF THE INVENTION

The present invention relates to brooms and, more particularly, to brooms with hooked bristle sections.

Debris will tend to collect under hard to reach places like heating registers and refrigerators. Currently, when using a broom for cleaning, the broom will just push dirt and dust further under items such as refrigerators and the like.

As can be seen, there is a need for a broom that has hooked bristles that may reach under these objects and pull out the debris that exists underneath these items.

SUMMARY OF THE INVENTION

In one aspect of the present invention, a broom with hooked bristles section comprises: a broom handle; a broom head having an upper section, a lower section, a first side and a second side, wherein the upper section of the broom head attaches to the broom handle; a plurality of straight bristles attached to the first side of the of the lower section of the broom head; and a plurality of hooked bristles attached to the second side of the lower section of the broom head.

In another aspect of the present invention, a method for producing a broom with hooked bristles section comprises: providing a broom handle; providing a broom head having an upper section, a lower section, a first side and a second side; attaching the broom handle to the upper section of the broom head; attaching a plurality of straight bristles to the first side of the lower section of the broom head; and attaching a plurality of hooked bristles to the second side of the lower section of the broom head.

In another aspect of the present invention, method for collecting debris from underneath an object comprises: providing a broom with hooked bristles section that comprises a broom handle, a broom head having an upper section, a lower section, a first side and a second side, wherein the upper section of the broom head attaches to the broom handle, a plurality of straight bristles attached to the first side of the lower section of the broom head, and a plurality of hooked bristles attached to the second side of the lower section of the broom head; placing the broom with hooked bristles section along a floor, wherein the plurality of hooked bristles slides underneath an object; sweeping the broom with hooked bristles section, allowing the plurality of hooked bristles to collect debris located underneath the object; and pulling the broom with hooked bristles section out from underneath the object with the collected debris swept out with the plurality of hooked bristles.

These and other features, aspects and advantages of the present invention will become better understood with reference to the following drawings, description and claims.

DETAILED DESCRIPTION OF THE INVENTION

Figure 1:
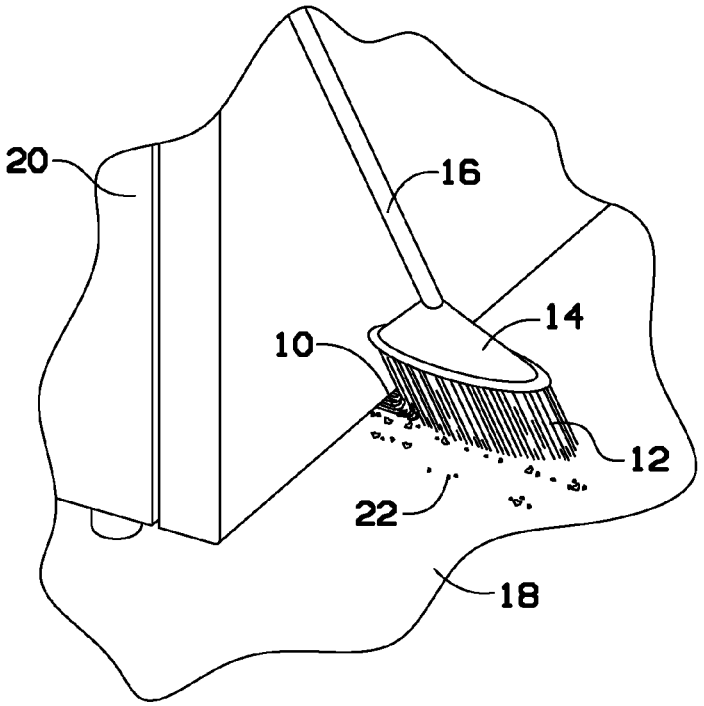
FIG. 1 is a perspective view of an exemplary embodiment of the present invention in use.
Figure 2:
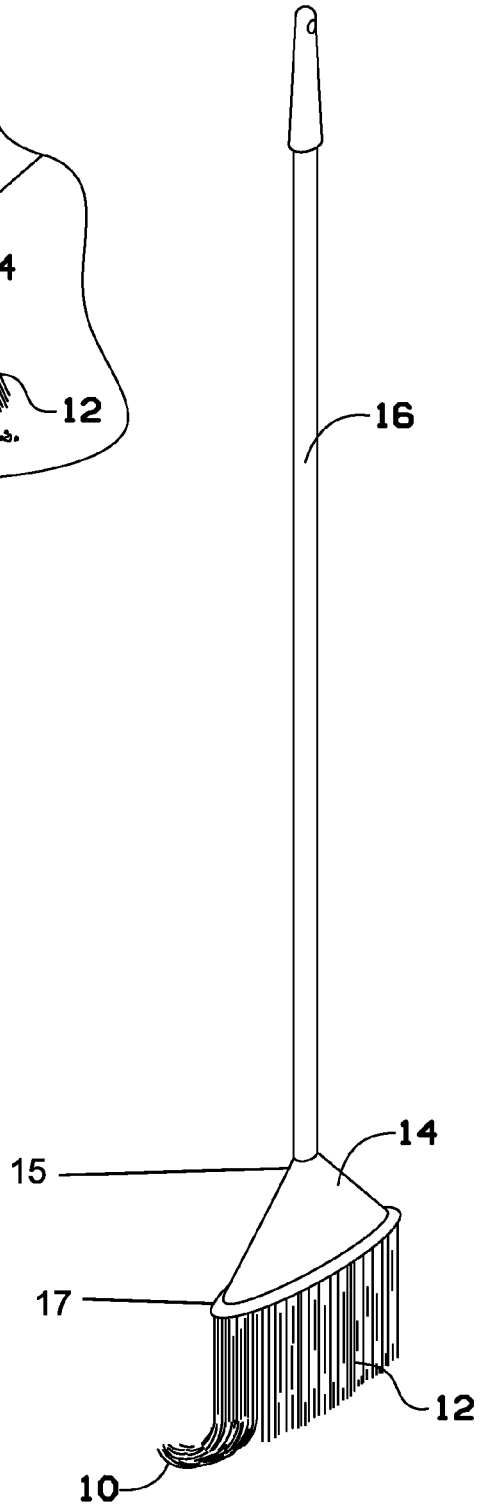
FIG. 2 is a perspective view of an exemplary embodiment of the present invention.
Figure 3:
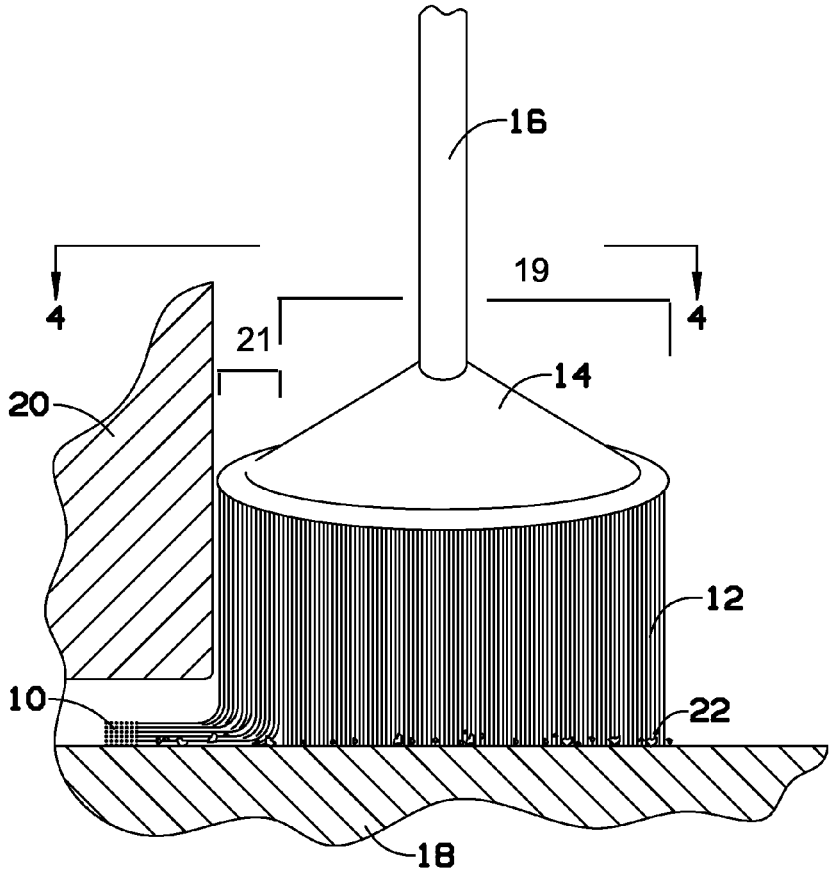
FIG. 3 is a front view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a broom with hooked bristles section that may include a broom handle and a broom head having an upper section, a lower section, a first side and a second side. The broom handle may attach to the upper section of the broom head. A plurality of straight bristles may attach to the first side of the lower section of the broom head, while a plurality of hooked bristles may attach to the second side of the lower section of the broom head. The plurality of hooked bristles allows for the ability to collect and remove debris from underneath objects.

As is illustrated in FIGS. 1 through 4, the broom with hooked bristles section may include a broom handle 16 and a broom head 14 having an upper section 15, a lower section 17, a first side 19 and a second side 21. The broom handle 16 may attach to the upper section 15 of the broom head 14. A plurality of straight bristles 12 may be attached to a first side 19 of the lower section 17 of the broom head 14. A second side 21 along the lower section 17 of the broom head 14 may include a plurality of hooked bristles 10. The plurality of hooked bristles 10 may attach to the second side 21 of the lower section 17 of the broom head 14 initially as straight bristles. Towards the end of the plurality of hooked bristles 10, the plurality of hooked bristles 10 may extend out and to the side from the plurality of straight bristles 12 in a hook shape. In certain embodiments, the plurality of hooked bristles 10 angle out parallel to the broom head 14 in an approximately 90 degree angle from the angle of the plurality of straight bristles 12.

Figure 4:
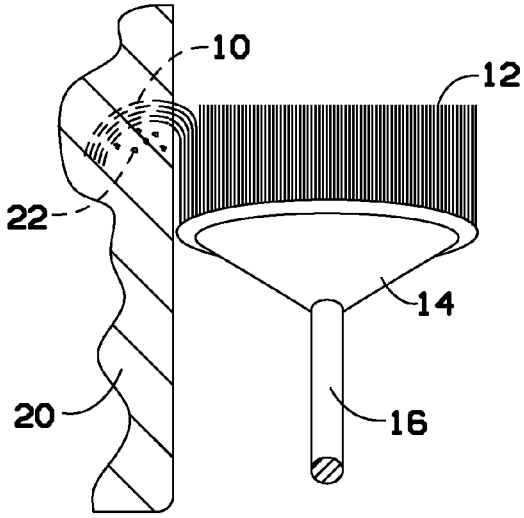
FIG. 4 is a section view of an exemplary embodiment of the present invention, taken along line 4-4 in FIG. 3.

The plurality of hooked bristles 10 allows the present device to extend underneath objects 20 such as refrigerators and the like. The plurality of hooked bristles may be angled so that the plurality of hooked bristles may slide underneath the object 20 and gather the debris 22 and dust that may lie underneath as is shown in FIG. 4. The debris 22 and dust may be collected and pulled out from underneath the object 20 as a user pulled the broom with hooked bristles section towards them along a floor 18. The debris 22 may collect within the hooked portion of the plurality of hooked bristles 10 and be swept out from underneath the object 20.

It should be understood, of course, that the foregoing relates to exemplary embodiments of the invention and that modifications may be made without departing from the spirit and scope of the invention as set forth in the following claims.

What is claimed is:

1. A broom with hooked bristles section comprising:

a broom handle;

a broom head having an upper section, a lower section, a first side extending along a majority of a longitudinal length of the broom head to a second side extending along a remaining portion of the longitudinal length of the broom head, and a transverse width, wherein the transverse width is substantially smaller than the longitudinal length, wherein the upper section of the broom head attaches to the broom handle;

a plurality of straight bristles attached to the first side of the lower section of the broom head; and a plurality of hooked bristles attached to the second side of the lower section of the broom head and a lower hooked end portion of the plurality of hooked bristles extends outwardly and generally aligned with the longitudinal length of the broom head.

2. The broom with hooked bristles section of claim 1, wherein the plurality of hooked bristles angle out parallel to the longitudinal length of the broom head in an approximately 90 degree angle from the angle of the plurality of straight bristles.

3. A method for producing a broom with hooked bristles section comprising:

providing a broom handle;

providing a broom head having an upper section, a lower section, a first side extending along a majority of a longitudinal length of the broom head to a second side extending along a remaining portion of the longitudinal length of the broom head, wherein a transverse width of the broom head is substantially smaller than the longitudinal length;

attaching the broom handle to the upper section of the broom head;

attaching a plurality of straight bristles to the first side of the lower section of the broom head; and attaching a plurality of hooked bristles to the second side of the lower section of the broom head and the plurality of hooked bristles having a lower hooked end portion that extends outwardly from the second side and generally aligned with the longitudinal length of the broom head.

4. The method of claim 3, wherein the plurality of hooked bristles angle out parallel to the longitudinal length of the broom head in an approximately 90 degree angle from the angle of the plurality of straight bristles.

5. A method for collecting debris from underneath an object comprising:

providing a broom with a hooked bristles section that comprises a broom handle, a broom head having an upper section, a lower section, a first side extending along a majority of a longitudinal length of the broom head to a second side extending along a remaining portion of the longitudinal length of the broom head, the broom head having a transverse width that is substantially smaller than the longitudinal length, wherein the upper section of the broom head attaches to the broom handle, a plurality of straight bristles attached to the first side of the lower section of the broom head, and a plurality of hooked bristles attached to the second side of the lower section of the broom head the plurality of hooked bristles having a lower hooked end portion that extends outwardly from the second side and generally aligned with the longitudinal length of the broom head;

placing the broom with hooked bristles section along a floor, wherein the plurality of hooked bristles slides underneath an object;

sweeping the broom with hooked bristles section, allowing the plurality of hooked bristles to collect debris located underneath the object; and pulling the plurality of hooked bristles out from underneath the object with the collected debris swept out with the plurality of hooked bristles.

6. The method of claim 5, wherein the plurality of hooked bristles angle out parallel to the longitudinal length of the broom head in an approximately 90 degree angle from the angle of the plurality of straight bristles.

* * * * *